US009308974B1

(12) United States Patent
Randall et al.

(10) Patent No.: US 9,308,974 B1
(45) Date of Patent: Apr. 12, 2016

(54) DRYING RACK AND ASSOCIATED METHODS

(71) Applicant: Project Rack, LLC, Clearfield, UT (US)

(72) Inventors: Jacob T. Randall, Layton, UT (US); Johnathan J. Heiner, Mesa, AZ (US); Travis J. Humble, Mesa, AZ (US)

(73) Assignee: Project Rack LLC, Layton, UT (US)

( * ) Notice: Subject to any disclaimer, the term of this patent is extended or adjusted under 35 U.S.C. 154(b) by 0 days.

(21) Appl. No.: 14/175,574

(22) Filed: Feb. 7, 2014

Related U.S. Application Data

(60) Provisional application No. 61/761,914, filed on Feb. 7, 2013.

(51) Int. Cl.
*B63B 29/00* (2006.01)

(52) U.S. Cl.
CPC ..... *B63B 29/00* (2013.01)

(58) Field of Classification Search
CPC ..... A47G 2025/1485; A47G 25/0685; A47G 25/16; A47G 25/32; B63B 29/00; B63B 35/85
USPC ..... 224/406, 927; 211/110, 111, 171; 248/218.4, 219.3; 114/343
See application file for complete search history.

(56) References Cited

U.S. PATENT DOCUMENTS

| | | | | |
|---|---|---|---|---|
| 2,232,249 | A * | 2/1941 | Losin | 24/716 |
| 4,948,019 | A * | 8/1990 | Rodum | 223/94 |
| 5,480,075 | A * | 1/1996 | Robinson | 223/88 |
| 5,752,638 | A * | 5/1998 | Meeks | 224/547 |
| 5,788,133 | A * | 8/1998 | Mareno | 224/406 |
| 5,901,890 | A * | 5/1999 | Stokes | 224/406 |
| 6,494,327 | B2 * | 12/2002 | Huang | 211/17 |
| 7,370,599 | B1 * | 5/2008 | Berman et al. | 114/364 |
| 8,047,492 | B2 * | 11/2011 | Wang | 248/307 |
| 2006/0037527 | A1 * | 2/2006 | Aff | 114/364 |
| 2007/0062992 | A1 * | 3/2007 | Hepworth et al. | 224/406 |
| 2008/0251548 | A1 * | 10/2008 | Mulderig | 223/85 |
| 2013/0256354 | A1 * | 10/2013 | Clark et al. | 224/482 |

OTHER PUBLICATIONS

Hangpro SlideHanger, available / for sale online at least as early as Nov. 20, 2010, available at http://thehangpro.com/slidehanger.aspx, last visited Feb. 4, 2014.

* cited by examiner

*Primary Examiner* — Corey Skurdal
(74) *Attorney, Agent, or Firm* — Adam R. Stephenson, Ltd.; Paul B. Johnson

(57) ABSTRACT

A drying rack includes a coupling mechanism configured to couple to a boat, a supporting member pivotably coupled to the coupling mechanism, and at least one hanger coupled to the supporting member and configured to hang a wet material to dry. The supporting member pivots, relative to the coupling mechanism, to a plurality of positions, at least one position allowing a longest length of the at least one hanger to be positioned substantially parallel to a deck of the boat. In implementations a cross member is coupled to the supporting member such that a longest length of the cross member is substantially perpendicular to a longest length of the supporting member. In implementations the cross member pivots, relative to the supporting member, to a plurality of positions, at least one position allowing a longest length of the cross member to be positioned substantially parallel to the deck of the boat.

19 Claims, 20 Drawing Sheets

DRYING RACK AND ASSOCIATED METHODS

CROSS REFERENCE TO RELATED APPLICATIONS

This document claims the benefit of the filing date of U.S. Provisional Patent Application 61/761,914, entitled "Drying Rack and Related Methods" listing as first inventor Jacob T. Randall, which was filed on Feb. 7, 2013, the disclosure of which is hereby incorporated entirely herein by reference.

BACKGROUND

1. Technical Field

Aspects of this document relate generally to implements configured for hanging wet articles of clothing, and the like, for drying purposes.

2. Background Art

Various implements are used for drying wet articles of clothing and the like. Clotheslines, gas or electric dryers, and the like, are often used for drying wet materials, though these are generally used at a user's home. When a user is on a boat or otherwise at a body of water, there generally is not an electric dryer, clothesline or similar item available to dry a wet piece of apparel or other material.

SUMMARY

Implementations of drying racks may include: a coupling mechanism configured to couple to a boat; a supporting member pivotably coupled to the coupling mechanism; and at least one hanger coupled to the supporting member, the at least one hanger configured to hang a wet material to dry; wherein the supporting member is configured to pivot, relative to the coupling mechanism, to a plurality of positions, at least one of the plurality of positions of the supporting member allowing a longest length of the at least one hanger to be positioned substantially parallel to a deck of the boat.

Implementations of drying racks may include one, all, or any of the following:

The at least one hanger may be configured to hang the wet material in a configuration such that the wet material will not drip onto the deck.

The supporting member may be configured to allow the longest length of the at least one hanger to pivot counter-clockwise from a parallel position relative to the deck and clockwise from the parallel position relative to the deck.

The supporting member may be configured to allow the longest length of the at least one hanger to pivot at least 30 degrees counter-clockwise from the parallel position relative to the deck and at least 30 degrees clockwise from the parallel position relative to the deck.

Each hanger may include two slots and each slot may be at least partially defined by at least one inward projecting arm.

Each slot may be at least partially defined by two inward projecting arms.

The at least one hanger may be coupled to the supporting member using a cross member, a longest length of the cross member being substantially perpendicular to the longest length of the at least one hanger.

The coupling mechanism may be configured to fully circumscribe a bar of a boat tower of the boat in a tight configuration.

The drying rack may further include a bar of a boat tower, and the coupling mechanism may be attached to the bar.

A cross member may be coupled to the supporting member such that a longest length of the cross member is substantially perpendicular to a longest length of the supporting member; and the cross member may be configured to pivot, relative to the supporting member, to a plurality of positions, at least one of the plurality of positions of the cross member allowing the longest length of the cross member to be positioned substantially parallel to the deck of the boat.

Implementations of drying racks may include: a coupling mechanism configured to couple to a boat; a supporting member coupled to the coupling mechanism; a cross member coupled to the supporting member such that a longest length of the cross member is substantially perpendicular to a longest length of the supporting member; and at least one hanger coupled to the cross member, the at least one hanger configured to hang a wet material to dry; wherein the cross member is configured to pivot, relative to the supporting member, to a plurality of positions, at least one of the plurality of positions of the cross member allowing the longest length of the cross member to be positioned substantially parallel to a deck of the boat.

Implementations of drying racks may include one, all, or any of the following:

The at least one hanger may be configured to hang the wet material in a configuration such that the wet material will not drip onto the deck.

The supporting member may be configured to allow a longest length of the at least one hanger to pivot counter-clockwise from a parallel position relative to the deck and clockwise from the parallel position relative to the deck.

The supporting member may be configured to allow the longest length of the at least one hanger to pivot at least 30 degrees counter-clockwise from the parallel position relative to the deck and at least 30 degrees clockwise from the parallel position relative to the deck.

Each hanger may include two slots and each slot may be at least partially defined by at least one inward projecting arm.

Each slot may be at least partially defined by two inward projecting arms.

The coupling mechanism may be configured to fully circumscribe a bar of a boat tower in a tight configuration.

The drying rack may further include a bar of a boat tower, and the coupling mechanism may be attached to the bar.

Implementations of a drying rack may include: a coupling mechanism configured to attach to a boat tower of a boat by fully circumscribing a bar of the boat tower in a tight configuration; and a plurality of hangers coupled to the coupling mechanism, each hanger configured to hang a wet material to dry such that the wet material will not drip onto a deck of the boat; wherein each hanger includes two slots and each slot is defined by at least one inward projecting arm, the two slots of each hanger configured to together receive a life jacket by each slot receiving a shoulder portion of the life jacket.

Implementations of a drying rack may include one, all, or any of the following:

The drying rack may further include the bar of the boat tower, and the coupling mechanism may be attached to the bar.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
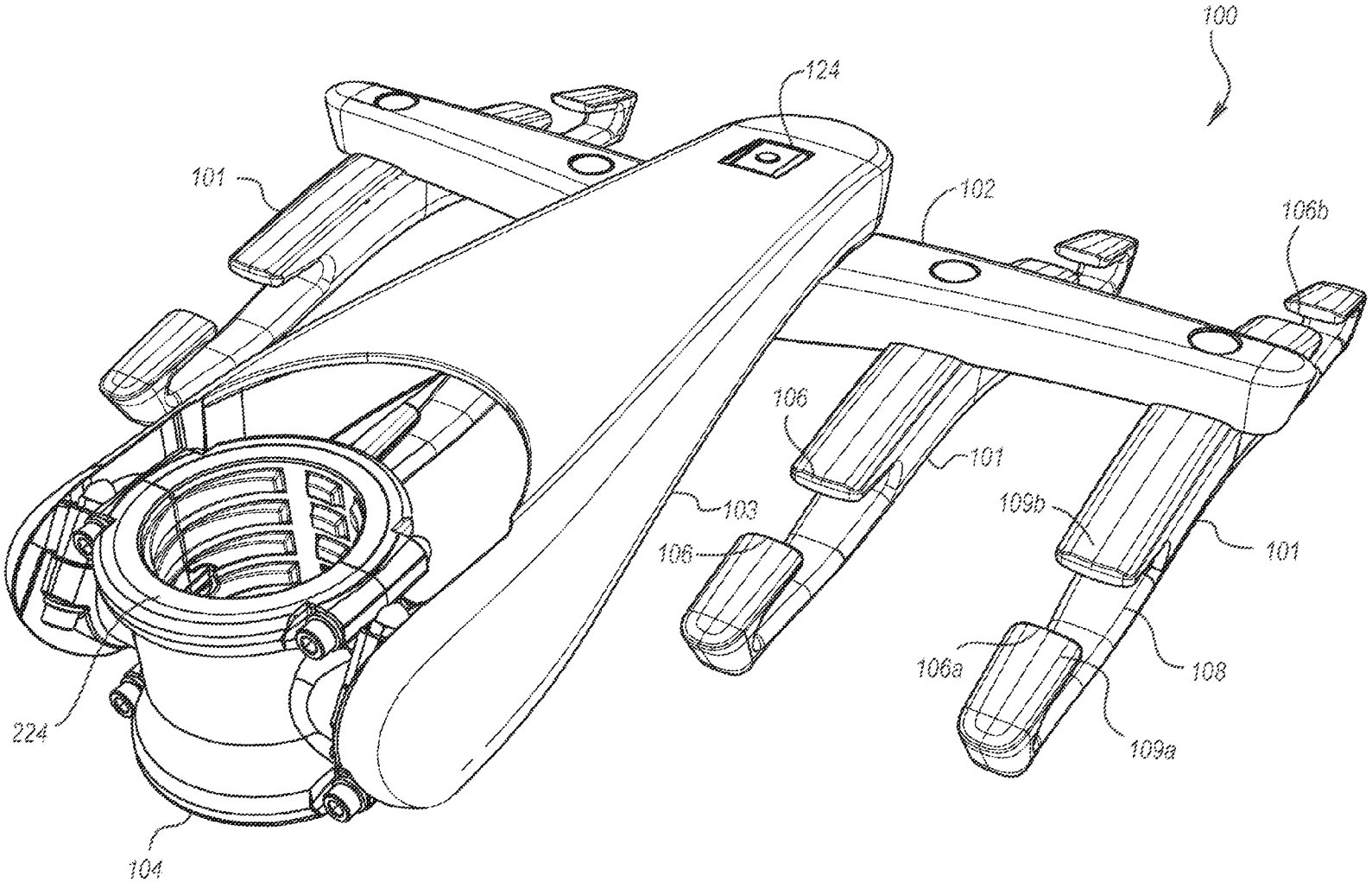
FIG. 1 is a top perspective view of an implementation of a drying rack (rack)
Figure 2:
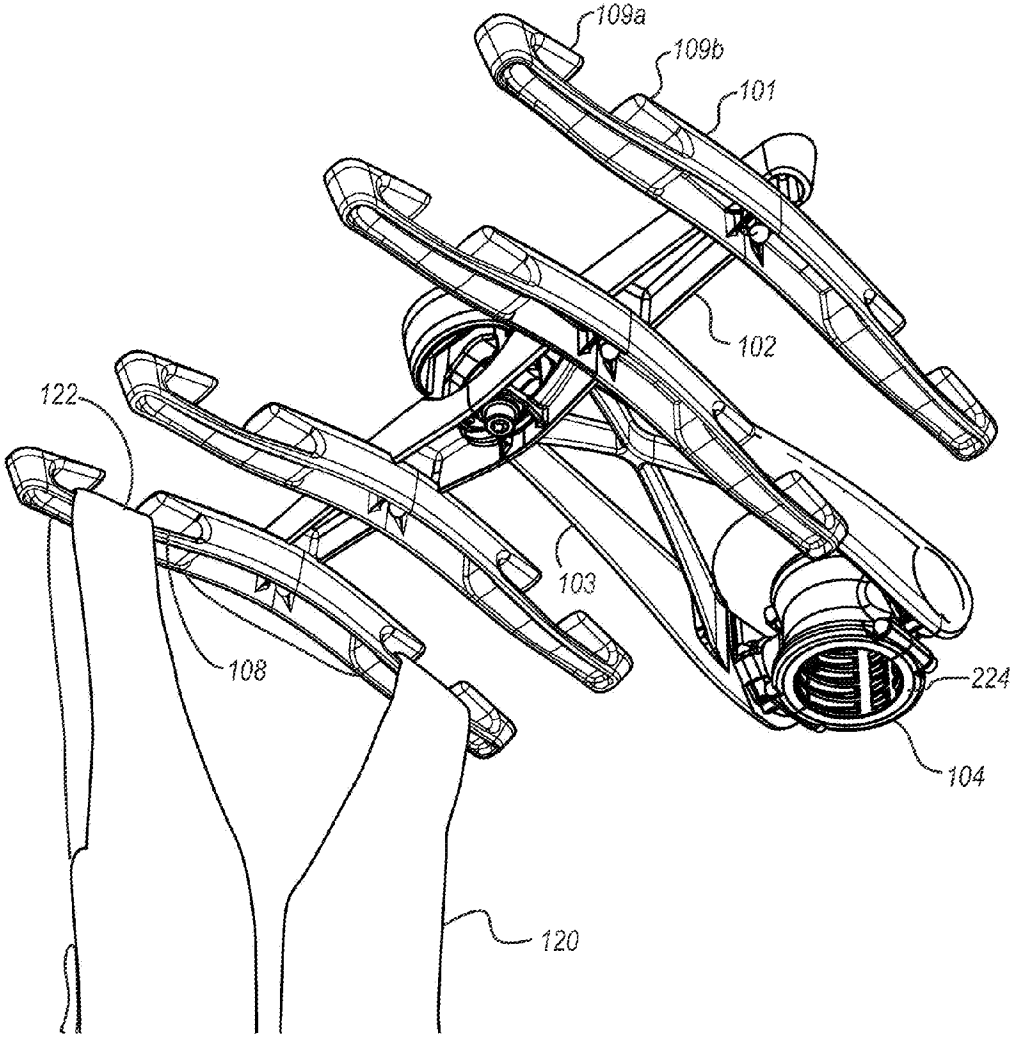
FIG. 2 is a bottom perspective view of the perspective view of the rack of FIG. 1 with a life jacket hanging thereon.

This disclosure, its aspects and implementations, are not limited to the specific components, assembly procedures or method elements disclosed herein. Many additional components, assembly procedures and/or method elements known in the art consistent with the intended drying racks and associated methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such drying racks and associated methods, and implementing components and methods, consistent with the intended operation and methods.

As used herein, "boat tower" and "tower" each mean a structure formed of solid or hollow tubing—with a circular, square, rectangular, triangular, oval, hybrid, irregularly shaped, or other type of cross section—configured to attach to a boat, and configured to raise a tow point of a tow line to a desired height. A boat tower may be, by non-limiting example, a wakeboard tower. Examples of boat towers are given in APPENDIX A, the disclosure of which is entirely incorporated herein by reference.

Referring now to FIGS. 1-6, in implementations a drying rack 100 includes a coupling mechanism 104 configured to couple to a boat 140. In implementations the coupling mechanism 104 is configured to couple to a boat tower (tower) 130, though in other implementations the coupling mechanism 104 could be configured to couple to another portion of a boat 140, such as on a top, a side, or a front or rear portion of the boat 140. In implementations the coupling mechanism 104 could be configured to couple to a bar that is on a boat 140 but is not part of a boat tower 130. In implementations the coupling mechanism 104 includes a first section 105 and a second section 107 which are configured to couple together to form a cylindrical shape though, in other implementations, they could form a rectangular, triangular, cuboidal, or any other regular or irregular shape—and at any rate they could include any shape that is similar or the same as that of any bar 222 of a boat tower 130.

The first section 105 and second section 107 are configured to engage a size adjuster 224 of the coupling mechanism 104 and to be tightened around the size adjuster 224 using bolts 110 which are run through washers 112 and coupled to nuts 114. The size adjuster 224 in implementations includes a first section 226 and a second section 228 which are configured to mate to form a cylindrical shape though, in other implementations, they could form a rectangular, triangular, cuboidal, or any other regular or irregular shape—and at any rate they could include any shape that is similar or the same as that of any bar 222 of a boat tower 130. In implementations the size adjuster 224 is formed of a relatively easily-compressible material such as a rubber, soft plastic or foam. In other implementations the size adjuster 224 could be formed of less compressible materials such as a harder rubber, plastic or foam. In implementations the size adjuster 224 may be exchanged for different-shaped or different-sized size adjusters 224 to accommodate different shaped or sized bars 222 to which the coupling mechanism 104 will be coupled. In implementations the tightening of the first section 105 and second section 107 around the size adjuster 224, while the size adjuster 224 is coupled around a bar 222, allows the coupling mechanism 104 to attach to and fully circumscribe the bar 222 in a tight configuration such that the coupling mechanism 104 may remain in place regardless of moderate stresses caused by, for example, the movement of the boat 140 as it speeds and turns along on a body of water, the weight from the other elements of the drying rack 100, the weight of any wet materials hanging on the drying rack 100, and so forth.

Figure 3:
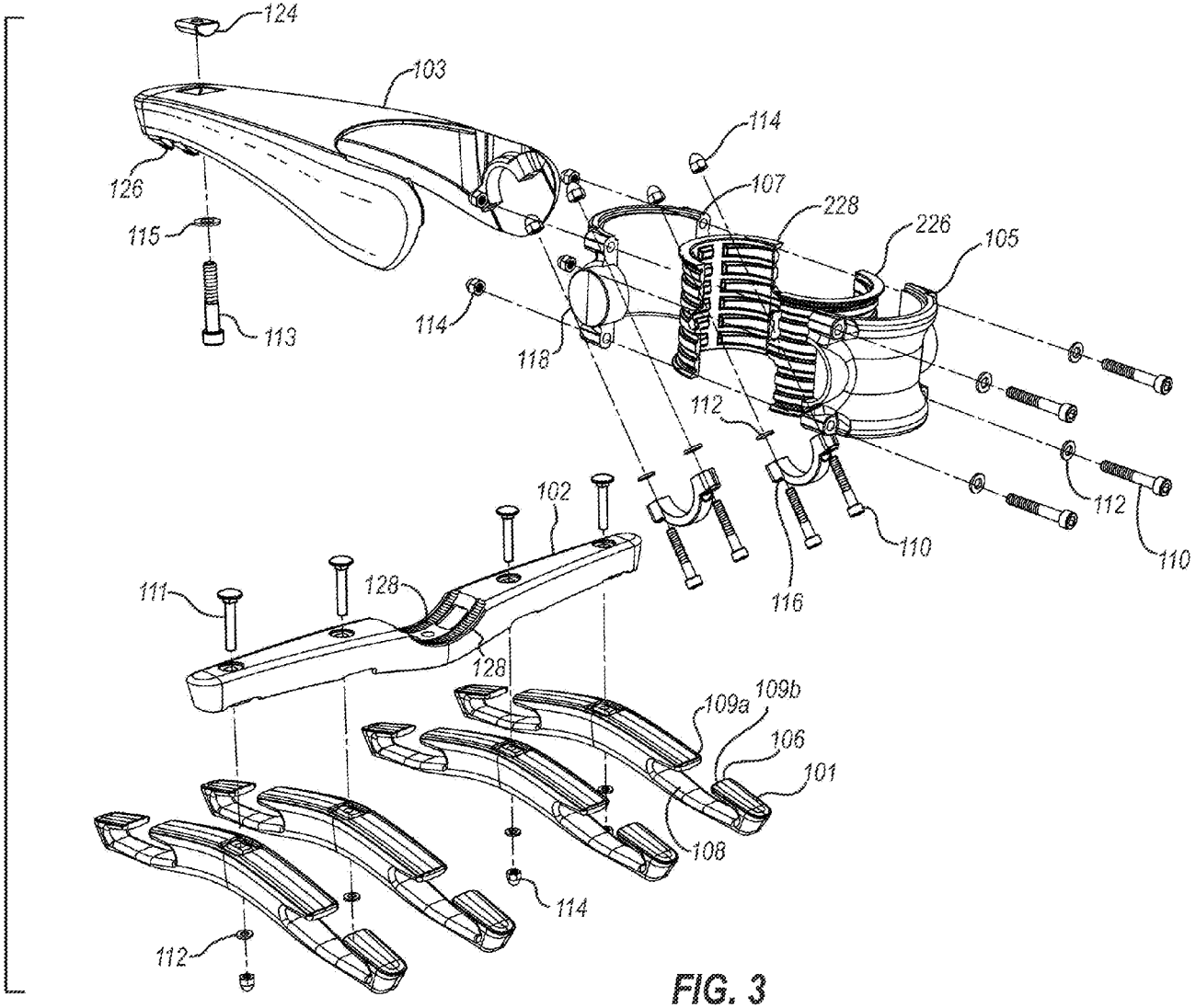
FIG. 3 is an exploded view of the rack of FIG. 1.
Figure 4:
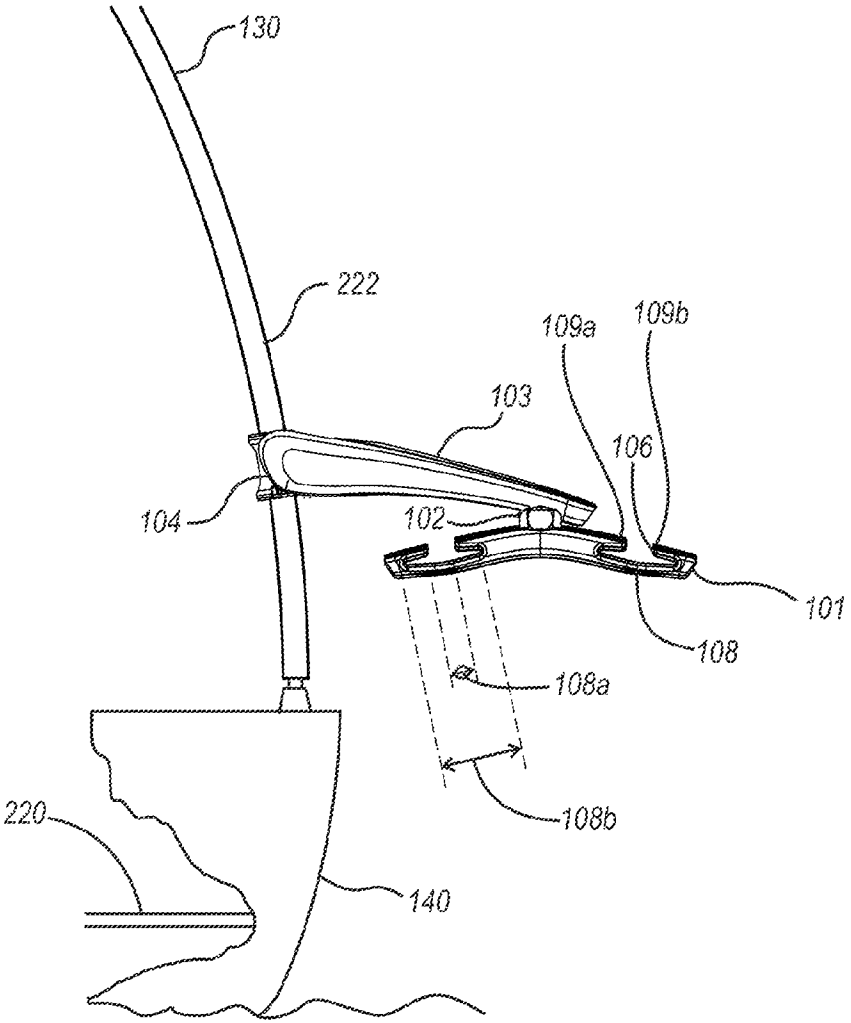
FIG. 4 is a side view of the rack of FIG. 1 attached to a bar of a boat tower, looking from a rear of a boat towards a front of the boat.

In implementations a supporting member 103 is coupled to the coupling mechanism 104. In implementations these two could be coupled in a fixed configuration, though in implementations the supporting member 103 is pivotably coupled to the coupling mechanism 104 to a plurality of positions. By non-limiting example, referring to FIG. 3, in implementations the supporting member 103 includes a pair of clamps 116, each clamp 116 configured to circumscribe a circular members 118 of the coupling mechanism 104, and to be tightened using bolts 110 passing through washers 112 and coupled to nuts 114. When it is desirable to alter the tilt of the supporting member 103 relative to the coupling mechanism 104, the bolts 110 may be loosened, thus loosening the grip of the clamps 116 around the circular members 118, the supporting member 103 may be rotated to a desired position, and the bolts 110 may again be tightened to secure the supporting member 103 at the desired position. This may be useful, for instance, making reference to FIG. 4, where an element to which the coupling mechanism 104 is coupled, such as a bar 222 of a boat tower 130, is at an angle and is not substantially vertical or perpendicular relative to a deck 220 of the boat 140. The portion of the boat 140 shown in FIG. 4 is the rear of the boat 140, thus the view is looking from the rear of the boat 140 towards the front of the boat 140. As can be seen from APPENDIX A, boat towers 130 are often at varying angles relative to the deck 220 of a boat 140 when viewed from this angle. Accordingly, the ability of the supporting member 103 to pivot relative to the coupling mechanism 104 may be useful in that it may allow the hangers 101, which are coupled to the supporting member 103, to be substantially parallel, or parallel, to the deck 220. For example, in implementations the pivoting nature of the supporting member 103 may allow a longest length of each hanger 101 to be parallel, or substantially parallel, with a deck 220. In implementations the supporting member 103 may be pivotable clockwise from this parallel position and counter-clockwise from the parallel position. In implementations the supporting member 103 may be pivotable in clockwise and counter-clockwise directions by as much as 30 degrees, though in other implementations it may be thus pivotable in either direction by anywhere from zero to 90 degrees, such as, by non-limiting example, 5, 10, 15, 20, 25, 35, 40, 45, 50, 55, 60, 65, 70, 75, 80, 85, and/or 90 degrees, or any amount in between.

Figure 5:
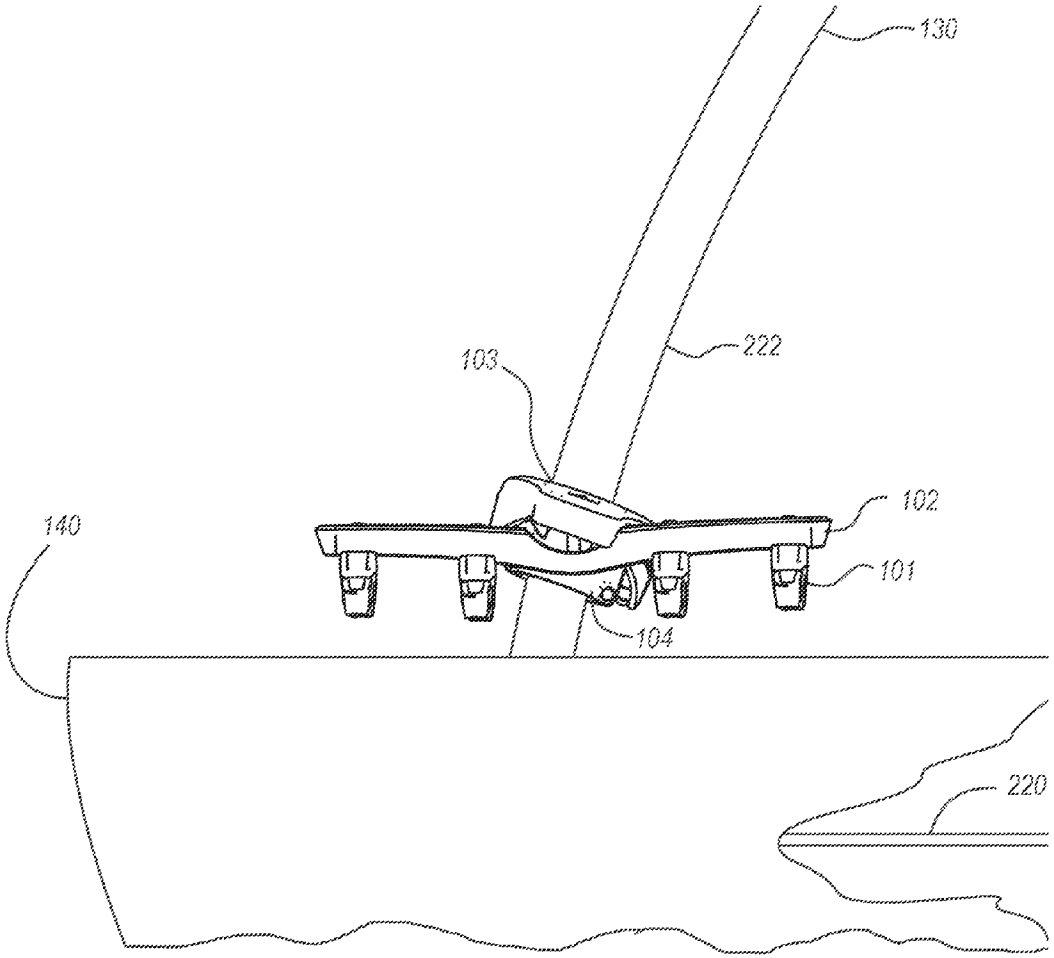
FIG. 5 is a front view of the rack of FIG. 1 attached to a bar of a boat tower, looking from a side of a boat towards the other side of the boat.
Figure 6:
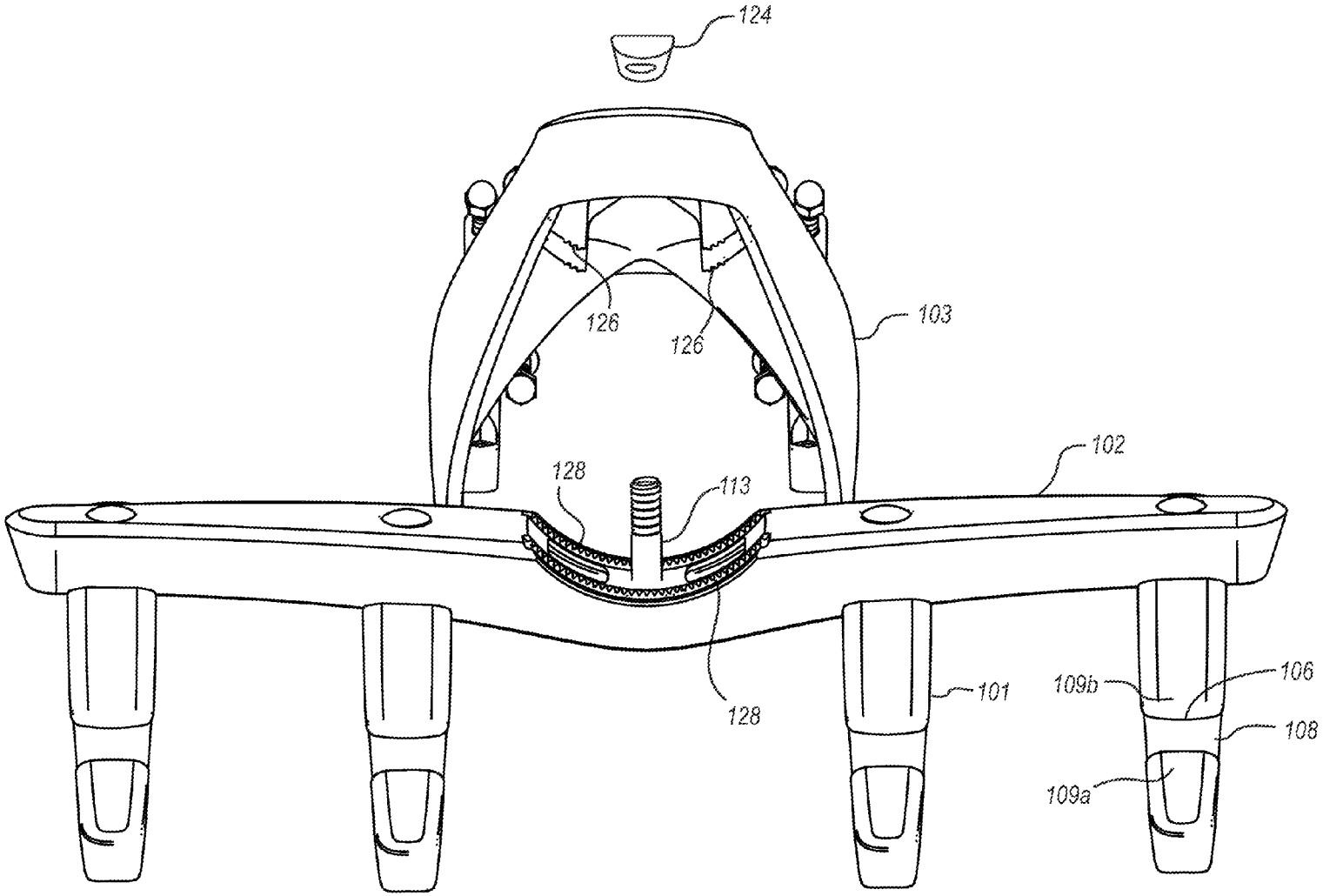
FIG. 6 is a front view of a supporting member, cross member and related elements of the rack of FIG. 1.
Figure 7:
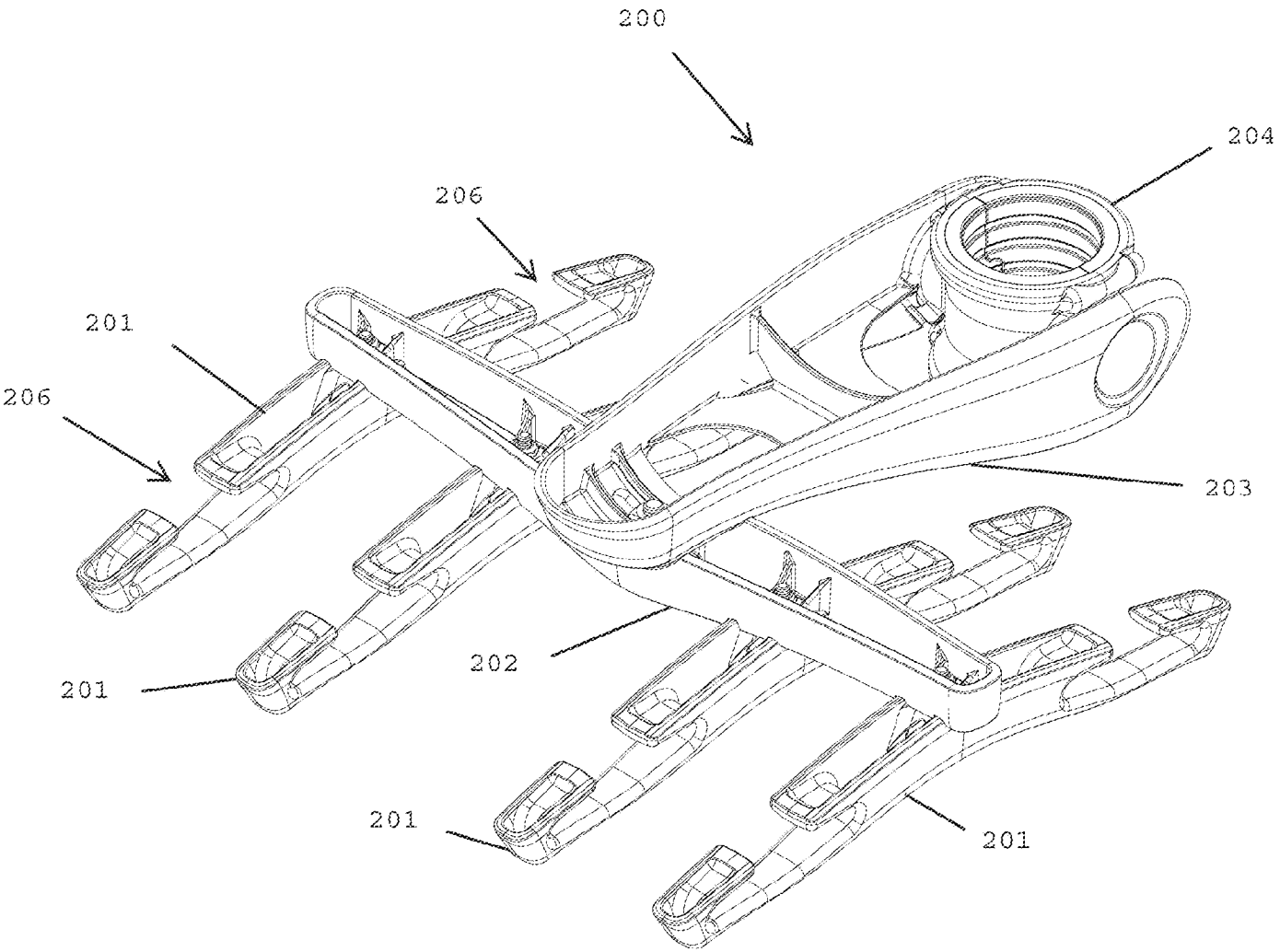
FIG. 7 is a top front perspective view of another implementation of a drying rack (rack)
Figure 8:
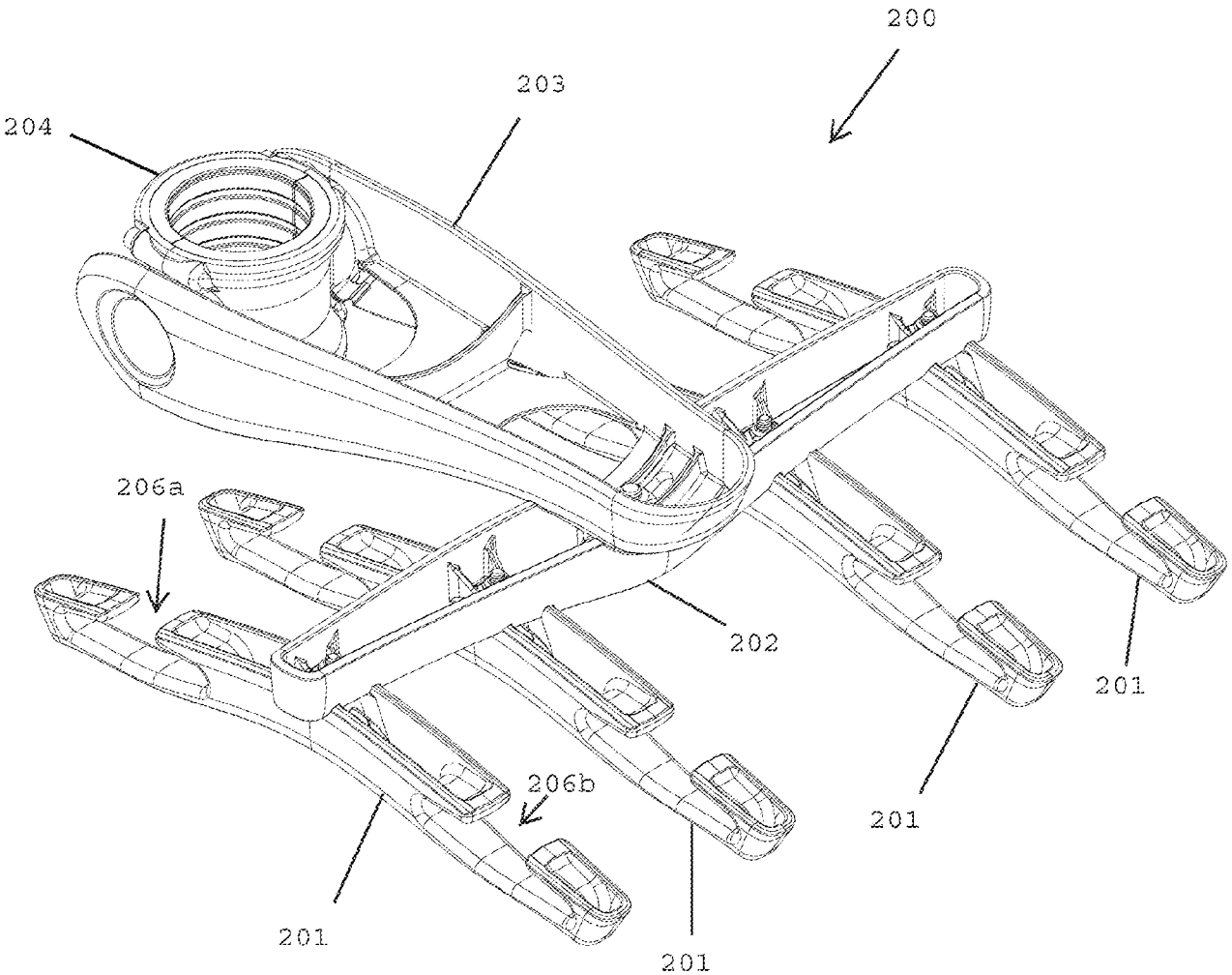
FIG. 8 is another front perspective view of the rack of FIG. 7.
Figure 9:
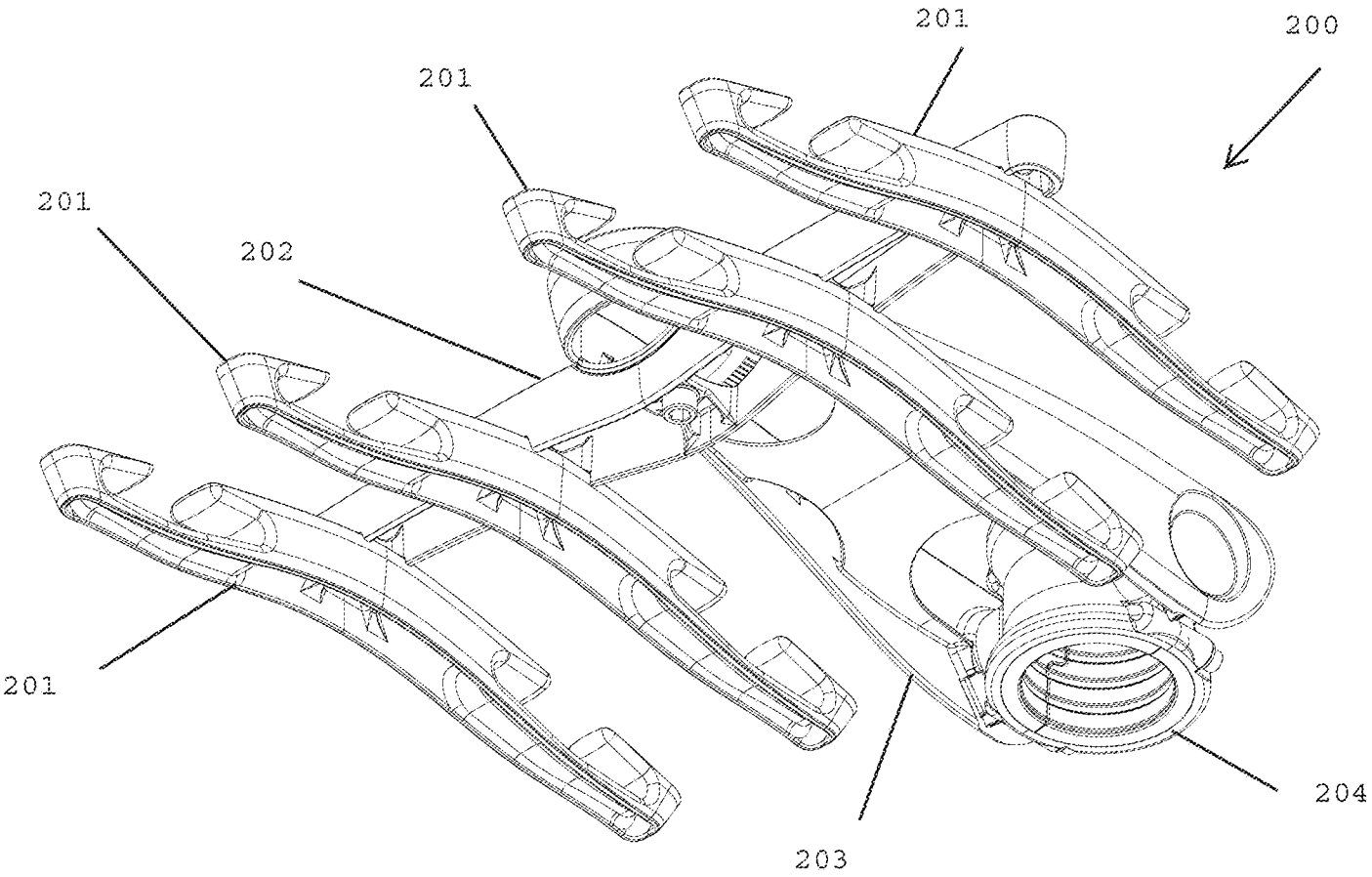
FIG. 9 is front bottom perspective view of the rack of FIG. 7.
Figure 10:
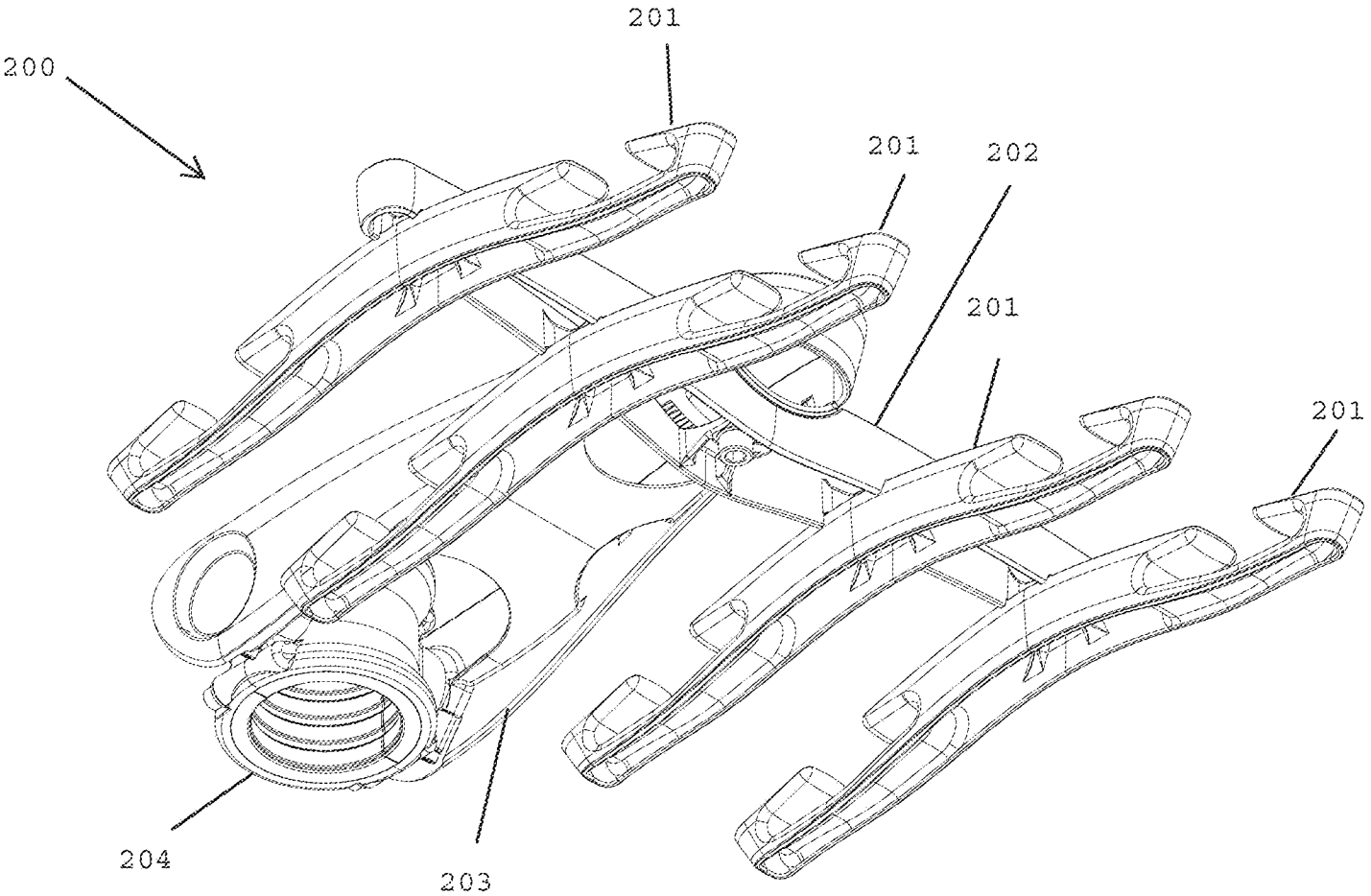
FIG. 10 is another front bottom perspective view of the rack of FIG. 7.
Figure 11:
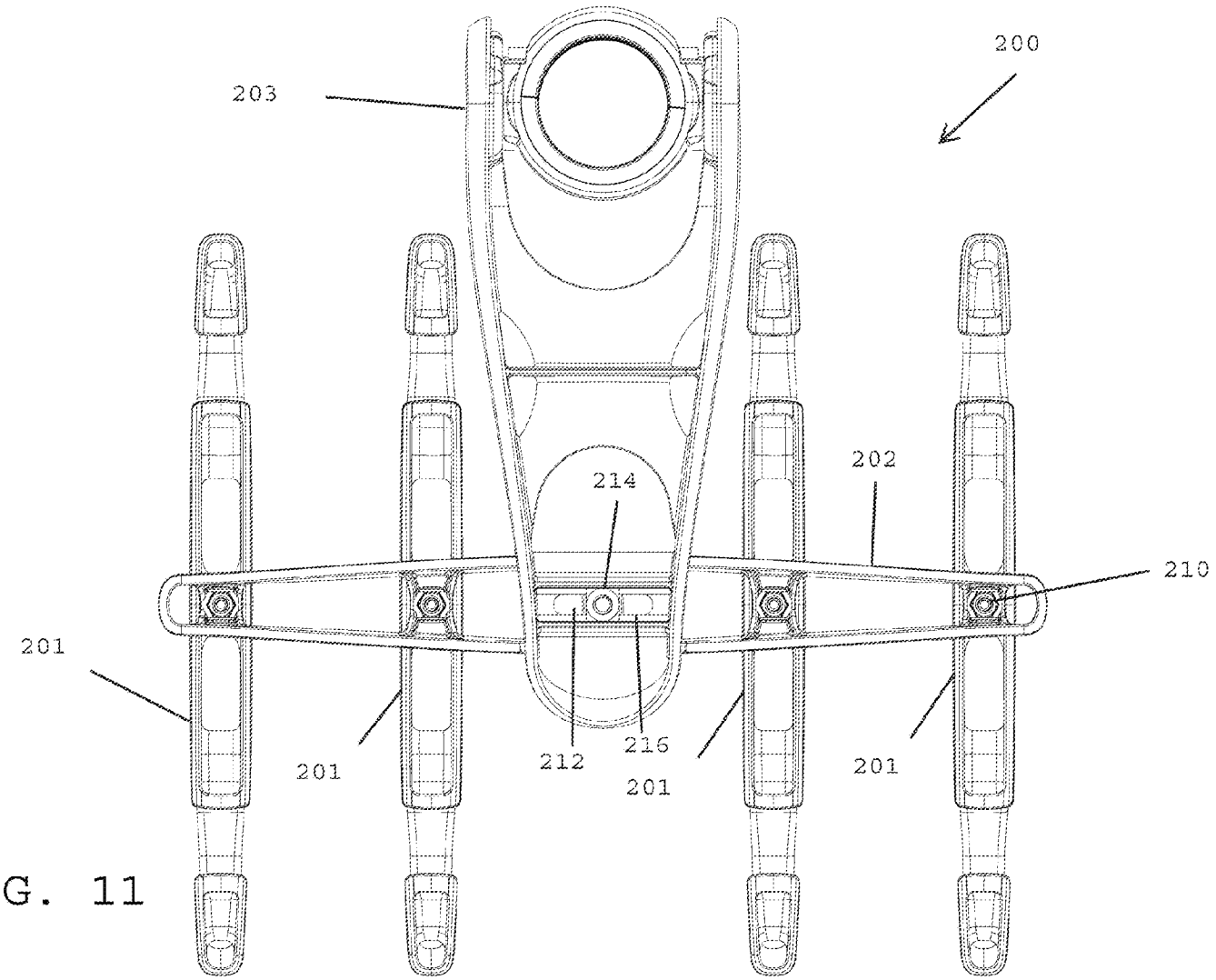
FIG. 11 is a top view of the rack of FIG. 7.
Figure 12:
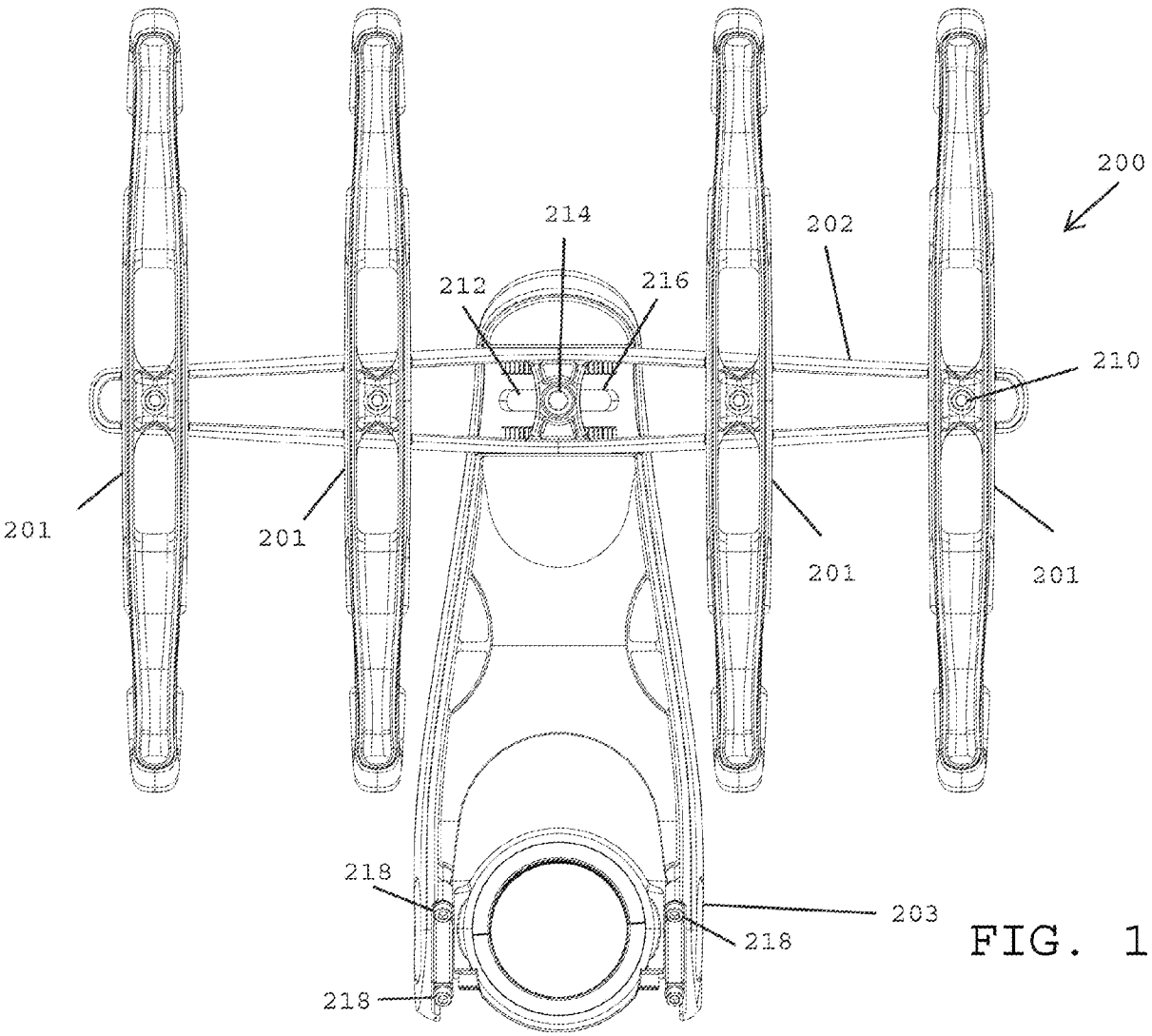
FIG. 12 is a bottom view of the rack of FIG. 7.
Figure 13:
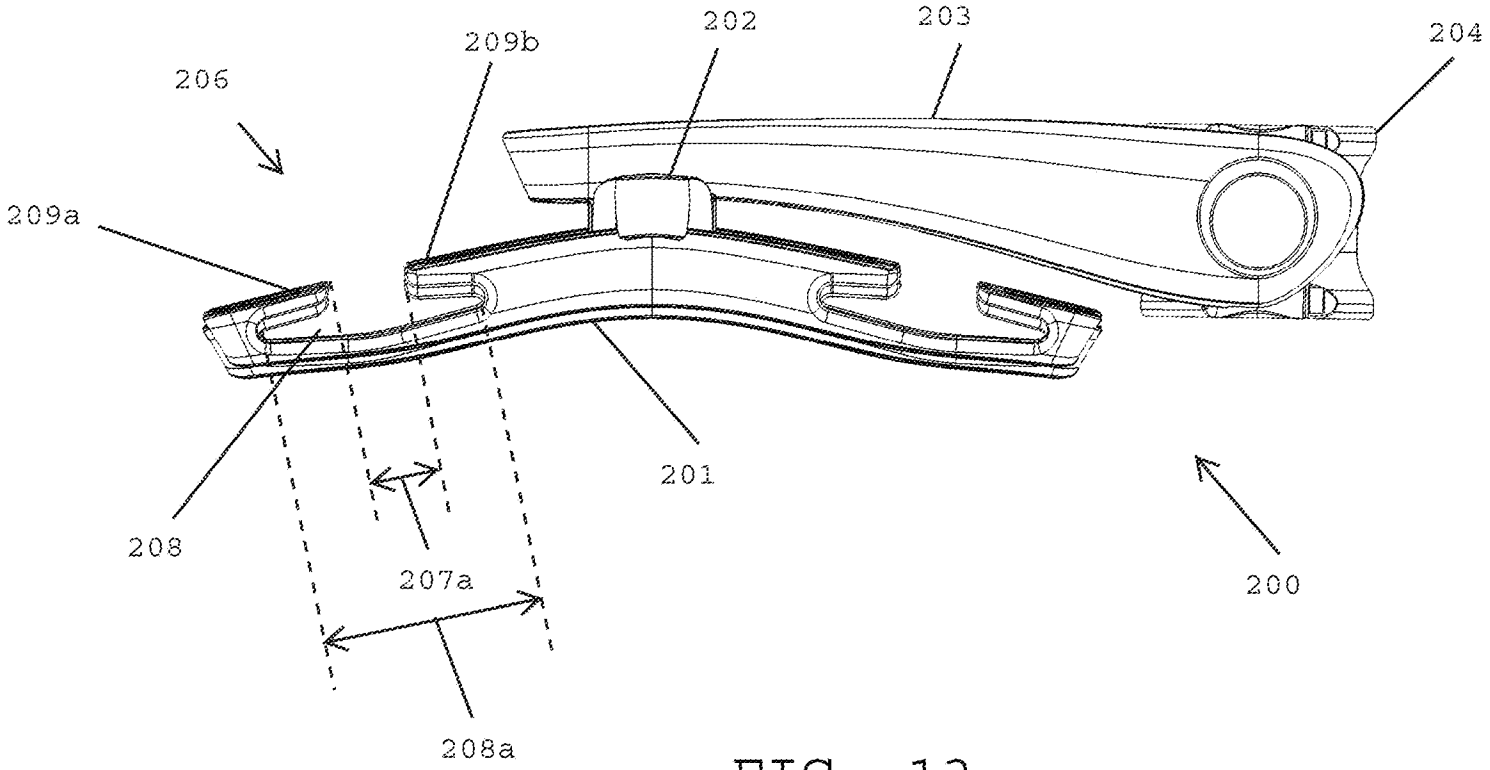
FIG. 13 is a left side view of the rack of FIG. 7.

In implementations a cross member 102 is coupled to the supporting member 103. In implementations the cross member 102 has a longest length that is substantially perpendicular, or perpendicular, to a longest length of the supporting member 103. In implementations the cross member 102 is tiltable to a plurality of positions or angles relative to the supporting member 103. Referring now to FIGS. 3 and 5-6, in implementations the supporting member 103 includes teeth 126 that are configured to mate with grooves 128 in the cross member 102. When a desired tilt or rotation of the cross member 102 relative to the supporting member 103 is achieved, a bolt 113 which passes through a washer 115 may be tightened into pivoting nut 124, thus pressing the teeth 126 and grooves 128 in a tight configuration and locking the desired tilt in place. The pivoting nut 124 has a curved underside allowing it to mate with a curved portion of the supporting member 103 in a tight configuration when the bolt 113 is tightened regardless of the angle of the bolt 113 caused by the tilt. Thus these members work together to allow the tilt to be realized and selectively secured into place. When a different tilt is desired, the bolt 113 may be loosened, a different tilt selected, and the bolt 113 re-tightened to lock the tilt into place.

Referring to FIG. 5, the tilting nature of the cross member 102 relative to the supporting member 103 may be useful, by non-limiting example, when the element to which the coupling mechanism 104 is coupled, such as a bar 222 of a boat tower 130, is not directly or substantially vertical or perpendicular relative to the deck 220 of the boat 140. The portion of the boat 140 visible in FIG. 5 is the side of the boat 140, thus the view is looking at a side of the boat 140 towards the other side of the boat 140. As shown in APPENDIX A, in implementations many boat towers 130, looking from the side, are not perpendicular or substantially perpendicular to the deck 220 of the boat 140. Thus the tilting nature of the cross member 102 may allow the cross member 102 to be tilted such that a longest length of the cross member 102 is parallel, or substantially parallel, with the deck 220. In implementations where a cascading configuration is desired for the hangers 101, the cross member 102 may be intentionally given a tilt that is not parallel with the deck 220. In implementations the cross member 102 may be pivotable clockwise from the parallel position and counter-clockwise from the parallel position. In implementations the cross member 102 may be pivotable in clockwise and counter-clockwise directions by as much as 30 degrees, though in other implementations it may be thus pivotable in either direction by anywhere from zero to 90 degrees, such as, by non-limiting example, 5, 10, 15, 20, 25, 35, 40, 45, 50, 55, 60, 65, 70, 75, 80, 85, and/or 90 degrees, or any amount in between.

In implementations, due to the nature of the element, such as the bar 222 of a boat tower 130 to which a drying rack 100 is coupled, both the supporting member 103 and the cross member 102 will need to be adjusted, or pivoted or tilted, to a new setting in order to place the longest length of the cross member 102 and the longest length of each hanger 101 in parallel or substantially parallel configurations relative to the deck 220.

In implementations one or more hangers 101 are coupled to the coupling mechanism 104. In implementations one or more hangers 101 could be coupled to the coupling mechanism 104 by being attached directly to the coupling mechanism 104, or in other implementation the one or more hangers 101 could be attached to the supporting member 103. In the implementations shown the one or more hangers 101 are coupled to the coupling mechanism 104 by being attached to the cross member 102 using bolts 111 which are passed through washers 112 and coupled to nuts 114. In other implementations other attachment mechanisms could be used such as a friction fit, a glue, and the like. Any number of hangers 101 could be included—in the drawings there are always four hangers 101, but in other implementations there could be 1, 2, 3, 5, 6, 7, 8, 9, 10, or more hangers 101. In implementations each hanger 101 is configured so that its longest length is perpendicular to, or substantially perpendicular to, a longest length of the cross member 102.

Each hanger 101 has at least one slot 108 configured to receive a wet material to be dried. For example, in FIG. 2 the slots 108 are shown each receiving a shoulder region 122 of a life jacket 120. In these implementations shown each hanger 101 includes two slots 108, and they are generally spaced so as to receive the two shoulder region 122 of the life jacket 120. In other implementations there could be only one slot 108 in each hanger 101. In implementations the hanger 101 includes at least one inward projecting arm 109*a* or 109*b* which at least partially defines the slot 108. In implementations there are two inward projecting arms 109*a-b* proximate to each slot 108, each inward projecting arm 109*a-b* at least partially defining the slot 108. In implementations at least one inward projecting arm 109*a-b*, and in implementations two inward projecting arms 109*a-b*, define a slot opening 106 through which a shoulder region 122 could be inserted into the slot 108 and removed therefrom. In implementations the slot opening 106 is centered, or is substantially centered, relative to a longest length of the slot 108, though in implementations the slot opening 106 could be off-center. In an implementation in which there are two slots 108 in each hanger 101 there is thus a first slot opening 106*a* and a second slot opening 106*b*. In implementations a lateral dimension 108*a* of the slot opening 106 is smaller than a parallel or substantially parallel lateral dimension 108*b* of the slot 108.

In implementations the wet material may be any wet item such as, by non-limiting example: a wet life jacket 120, a wet towel, a wetsuit, a wet bathing suit, a wet article of clothing, and any other wet item.

In implementations a different coupling mechanism other than the coupling mechanism 104 could be utilized which does not fully circumscribe a bar 222 such as, by non-limiting example a clamp, or the like, which only partially circumscribes the bar 222 or, in other implementations, attaches to some other portion of the boat 140, such as the side of the boat 140, without attaching to the bar 222.

In implementations the drying rack 100 includes the bar 222 and the coupling mechanism 104 is circumscribed around the bar 222.

As can be seen from the drawings, because the drying rack 100 in implementations can be placed so that the hangers 101 would be over a body of water and not over the boat 140, the drying rack 100 may be configured such that a wet material hung on the hangers 101 will not drip onto the boat 140. In implementations the drying rack 100 is configured such that the wet material hung on the hangers 101 will not drip onto the deck 220.

Although specific implementing components and mechanisms have been discussed in relation to facilitating a tilt or pivot of the supporting member 103 relative to the coupling mechanism 104 and the tilt or pivot of the cross member 102 relative to the supporting member 103, and methods of attachment of the various components of a drying rack 100, and the like, it may be understood that other mechanisms and methods consistent with the operation thereof may be utilized.

Referring now to FIGS. 7-20, In implementations a drying rack (rack) 200 and associated methods relate to racks for storing, drying, and/or transporting equipment, including, by non-limiting example, apparel, life jackets 120, wetsuits, and the like. Implementations of a drying rack 200 and associated methods relate to boat-mounted (and other water-vessel-mounted) racks for storing, drying and/or transporting such equipment and/or related and/or similar items. In implementations a drying rack 200 and associated methods include systems, methods, and apparatuses for storing, drying, and/or transporting equipment or apparel used for water sports and/or otherwise associated with boating and/or water-related recreation. In implementations a drying rack 200 includes a rack for securely retaining equipment such as, by non-limiting example, life jackets 120, wet suits, and the like. In implementations the drying rack 200 has a series of hangers 201 used for securing apparel or other items. The series of hangers 201 in implementations is perpendicular to the body of a boat 140 and is attached using one or more bars or extensions to the boat 140, such as, by non-limiting example, a bar 222 of a tower 130.

Some boats 140 include towers 130 or other mechanisms for securing a tow rope to the boat 140 to enable towing of individuals utilizing water skis, wakeboards, knee boards, air chairs, and the like. In implementations some towers 130 come with a boat 140 and, in other implementations, a tower 130 may be installed on a boat 140 that does not have a preexisting tower 130. Other technologies accommodate storage of sports equipment such as, by non-limiting example: wakeboards, surfboards, water skis, and the like.

In implementations a drying rack 200 and related methods include systems, methods, and apparatuses for storing, drying, and/or transporting equipment or apparel used for water sports and/or otherwise associated with boating and/or water-related recreation. In implementations a drying rack 200 includes elements for securely retaining equipment such as, by non-limiting example, life jackets 120, wet suits, and the like. In implementations the drying rack 200 has one or more hangers 201 used for securing items such as, by non-limiting example: apparel, life jackets 120, wetsuits, towels, or other items. In implementations a longest length of each hanger 201 is perpendicular to a longest length of the boat 140 and is attached using one or more bars or extensions to the boat 140, such as a bar 222 of a boat tower 130.

In implementations the hangers 201 are each adapted to hold one or more life jackets 120 or other apparel or related item. In implementations the rack 200 may be fastened at different angles to the boat 140 to accommodate different conditions, including different environmental conditions and boat designs, differently-angled towers 130, and the like. By non-limiting example, implementations might allow increased air to flow between jackets or other items by cascading, optionally at equal intermediary distances, the series of hangers 201 in an upward or downward sloping angle. In implementations the rack 200 could be positioned so that items drying on it drip into the boat 140 or, if desired, positioned so that items drying on it drip outside the boat 140 (or, in other words, do not drip onto a deck 220 of the boat 140). Other implementations may use diverse methods of attaching the hangers 201 to the tower 130.

In some embodiments, the rack 200 may use a variety of coupling mechanisms, such as one or more clamps, plates, or collars to attach the rack 200, for example, to the tower 130 of a boat 140. Another technique would allow the rack 200 to be fastened to a frame of a wakeboard rack. The rack 200 could also be attached directly or indirectly to the hull of the boat 140 such as, by non-limiting example, by using a clamp or other coupling mechanism.

In some embodiments, the rack 200 also features diverse methods and mechanism for securing apparel or equipment to the rack 200 including, but not limited to, bungee cords, clasps and clamps. For example, a cord might be fastened to a hanger 201 and run through or around the apparel and attached back to the same hanger 201, a different hanger 201, or another portion of the rack 200. Alternatively, a cord may attach directly to the apparel itself, thereby securing it to the rack 200. Elements of the rack 200 may provide improved storage, drying and/or transportation of apparel and equipment, such as life jackets 120 used in water sports.

Other embodiments use hangers 201 of different shapes in order to accommodate different types of apparel. For example, a life jacket hanger 201 might have a shape that would allow it to hang in a form fitting manner and yet still allow free movement of the jacket, thus enabling improved and more rapid drying of the jacket. As another example, the hanger 201 might be shaped in a fashion to allow a wetsuit to be folded in half and secured to the rack 200 so that the wet suit can freely move without contacting an underlying portion of the boat 140 or rack 200. Another embodiment includes a mechanism for adjusting the distance between the hangers 201 or portions of a hanger 201 to secure apparel between the hangers 201 or portions of the hanger 201.

In implementations the hangers 201 may be substantially parallel to one another (in other words, a longest length of each hanger 201 may be parallel to a longest length of each other hanger 201), as illustrated in the drawings, or they may be non-parallel. The hangers 201 may be attached by a cross member 202 and, in implementations, a longest length of each hanger 201 may be perpendicular to or disposed at another angle relative to a longest length of the cross member 202. In implementations the cross member 202 may be attached to or integral with a supporting member 203.

Each hanger 201 may comprise one or more slots 208. Each slot 208 is accessible through a slot opening 206. The lateral dimension 208*a* of the slot 208 is greater than the lateral dimension 207*a* of the slot opening 206. The difference in the two lateral dimensions 207*a*, 208*a* is a result of inward projecting arms 209*a-b*. In implementations the slot opening 206 is centered relative to the slot 208. In embodiments the slot opening 206 is not centered with respect to the slot 208 such that the inward projecting arms 209*a-b* are not equal in length or, alternatively, one of the inward projecting arms 209*a-b* is omitted. Each slot opening 206 assists in securely retaining an article of clothing or equipment secured to the hanger 201.

In implementations the supporting member 203 is attached to or integral with at least a portion of a coupling mechanism 204. The coupling mechanism 204 may be utilized to secure the rack 200 to a bar 222 of a boat tower 130 or any other appropriate structure, such as a pylon on a ski boat. The coupling mechanism 204 may be embodied in a number of different ways and may include, by non-limiting example, a collar, a clamp, a weld, an industrial-strength adhesive, a bolt or set of bolts to be secured around or within an opening in a tower 130 of a boat 140, and the like.

It should be noted that all parts of the rack 200 may be machined, cast, or otherwise formed as a single element or they may be formed as separate elements and be joined such as, by non-limiting example, with any suitable type of fastener, by welding, by gluing, and the like.

In implementations the rack 200 is designed to accommodate four or more articles of clothing or equipment utilizing four hangers 201. In implementations, however, a different number of hangers 201 may be included. The shape of the hangers 201 may also differ depending on the types of apparel or other items being stored.

The rack 200 may comprise any suitable material, including but not limited to a variety of metals and/or alloys comprising aluminum, steel, etc. These materials may optionally include, for example, a water resistant coating, anodizing, chroming, or a polymer-based coating. In some embodiments, a mixture of different materials may be combined to create the rack 200. In one embodiment, the hangers 201 may be fashioned out of plastic while the cross and supporting members 202, 203 may be formed of metal. In implementations most components of the rack 200 may be formed of cast aluminum with a chrome finish, with other components (such as couplers 210, 214, 218 formed of stainless steel).

In implementations a shoulder region 122 of each life jacket 120 is retained within a slot 208 of the hangers 201 on the rack 200.

In implementations the rack 200 is secured to a tower 130 of a boat 140. In implementations the coupling mechanism 204 is utilized to secure the rack 200 to the tower 130 of a boat 140. The rack 200 may be secured to the boat 140 at different angles or at different positions on the boat 140 or tower 130 of the boat 140.

In implementations a method of securing a life jacket 120 to a rack 200 may include: positioning a first shoulder region 122 of a life jacket 120 within a first slot 208 of the rack 200, and; optionally positioning the second shoulder region 122 within a second slot 208 of the rack 200. The first slot 208 in which the first shoulder region 122 is secured may be on the same hanger 201 or on a different hanger 201 than the second slot 208 into which the second shoulder region 122 of the life jacket 120 is secured.

In implementations the cross member 202 may include a recessed groove in which a series of posts are slidably positioned. The posts may be individually repositioned within the groove. Also, the posts may be selectively secured to a hanger 201 or other item to which a life jacket 120 or other equipment may be secured.

Referring still to FIGS. 7-20, in implementations a rack 200 includes a set of hangers 201 each coupled to a cross member 202 using a coupler 210. In implementations the coupler 210 is, by non-limiting example, a threaded bolt, though in other implementations the coupler 210 could utilize, by non-limiting example, a friction fit, gravity, a glue, a magnet, and the like to couple the hanger 201 to the cross member 202.

Figure 17:
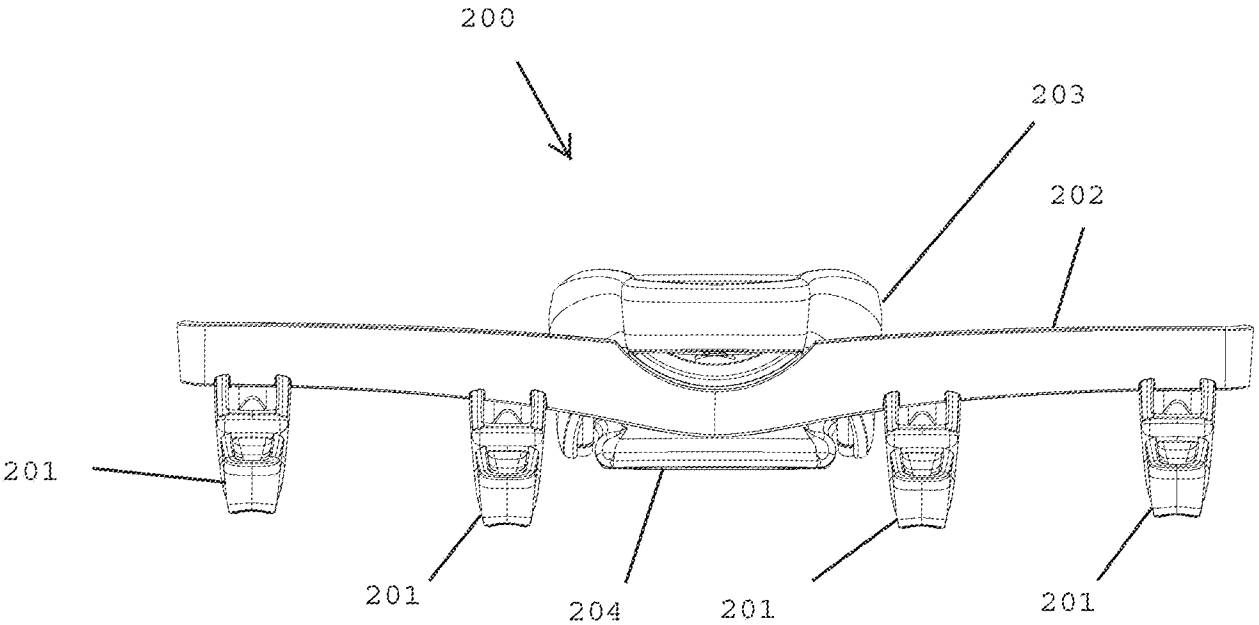
FIG. 17 is a front view of the rack of FIG. 7.
Figure 18:
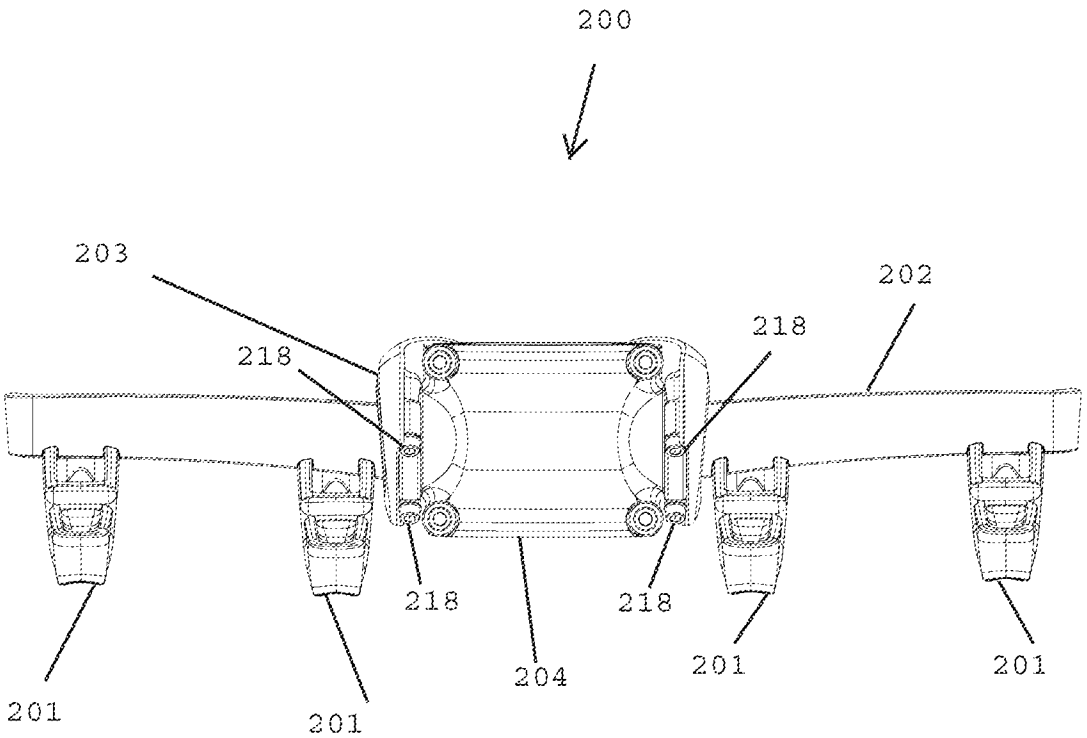
FIG. 18 is a rear view of the rack of FIG. 7.
Figure 19:
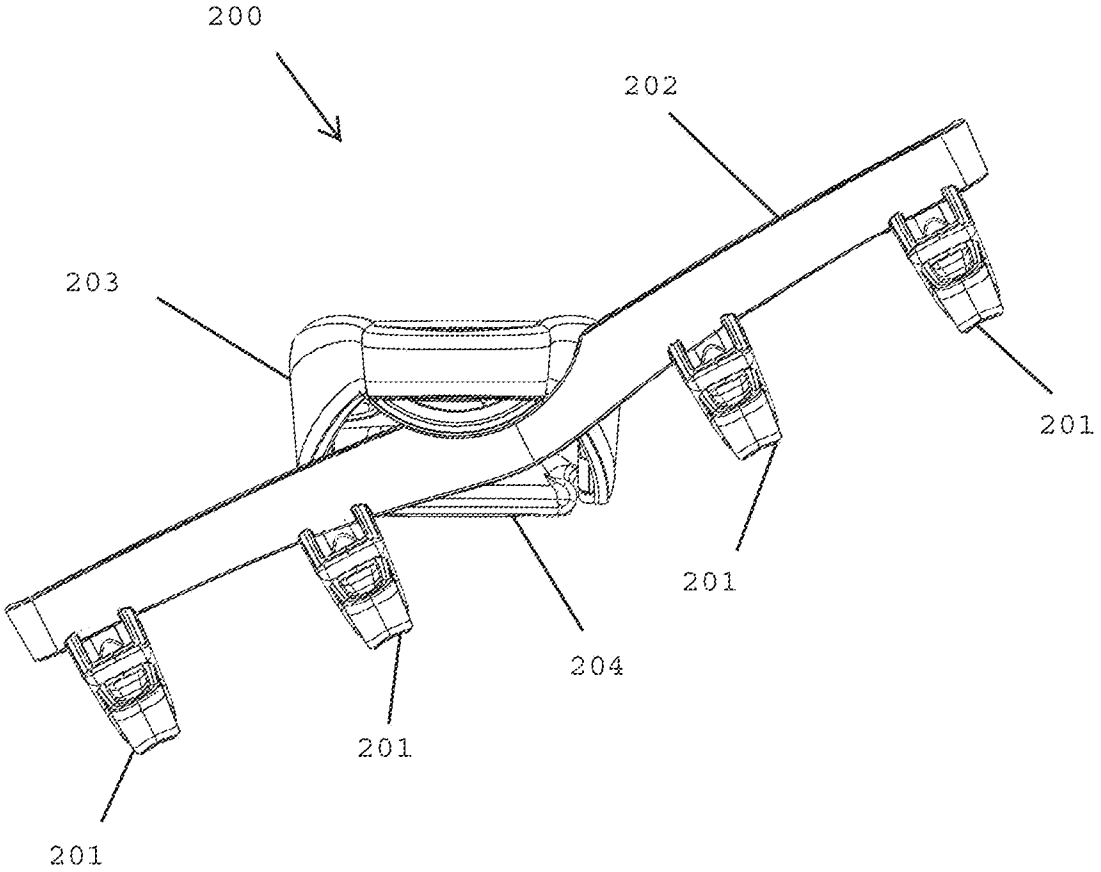
FIG. 19 is the rack of FIG. 17 with the cross member tilted to a counter-clockwise rotation.
Figure 20:
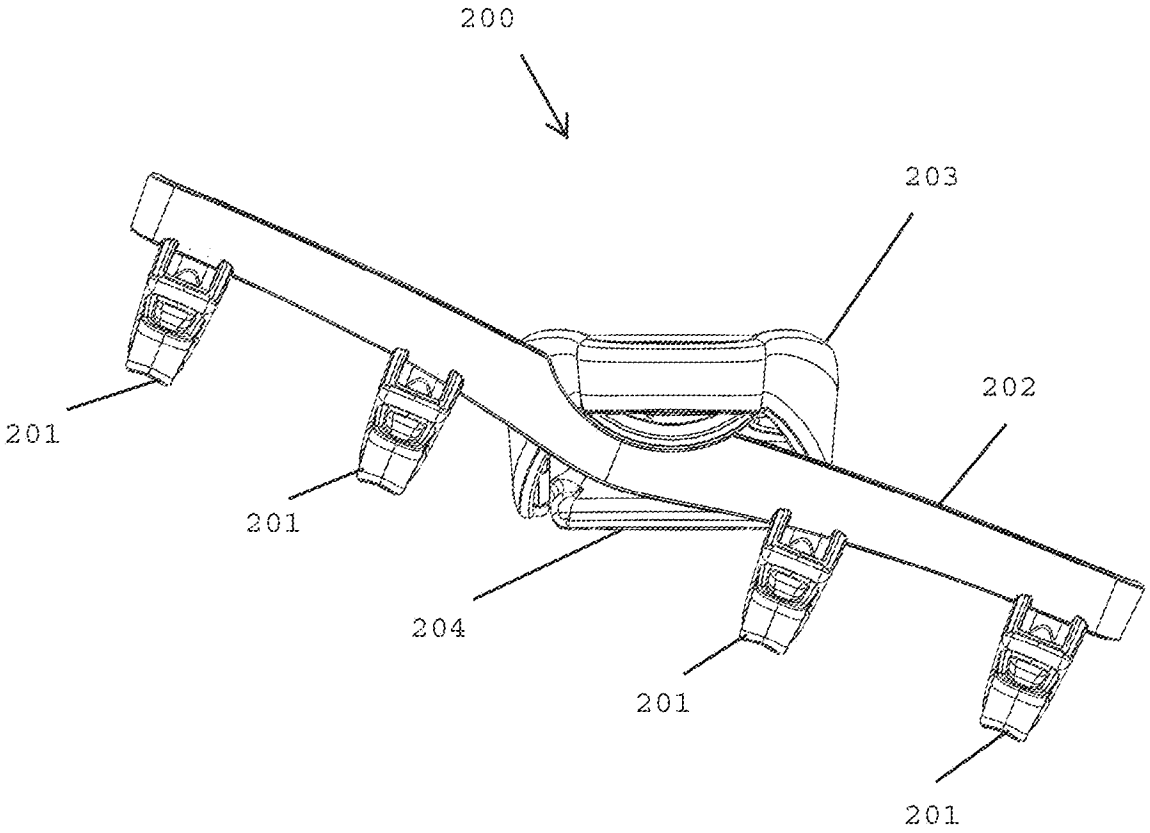
FIG. 20 is the rack of FIG. 17 with the cross member tilted to a clockwise rotation.

The cross member 202 is coupled to the supporting member 203 with a coupler 214. In implementations the coupler 214 is configured to allow the cross member 202 to be selectively rotatable with respect to the supporting member 203, along an axis substantially collinear with a longest length of the supporting member 203. By non-limiting example, in implementations the coupler 214 may comprise a threaded bolt and nut, the bolt passing through an arcuate slot 212 formed by an opening 216 in the supporting member 203. The arcuate slot 212 is configured such that the coupler 214 may be loosened, and the coupler 214 moved in the arcuate slot 212, then the coupler 214 tightened again, to selectively fix the cross member 202 at a desired rotation relative to the supporting member 203. Thus, for example, FIG. 17 illustrates a rack 200 in a position such that a longest length of the cross member 202 is generally coplanar with the longest length of the supporting member 203, while FIG. 19 illustrates a rack 200 with the cross member 202 fixed at a counterclockwise rotation relative to the supporting member 203, and FIG. 20 illustrates a rack 200 with the cross member 202 fixed at a clockwise rotation relative to the supporting member 203. Although the coupler 210 shown comprises a bolt and nut, in implementations the coupler 210 can include other mechanisms and/or elements to provide the selective securement of the cross member 202 at a desired rotation.

Although the cross member 202 in implementations is configured to hold four hangers 201, in implementations the cross member 202 may be configured to hold less or more hangers 201 such as, by non-limiting example, 1, 2, 3, 5, 6, 7, 8, 9, 10, or more hangers 201.

The rack 200 in implementations includes a coupling mechanism 204 coupled to the supporting member 203 and configured to couple to a tower 130 of a boat 140. In implementations, the coupling mechanism 204 is movably coupled to the supporting member 203 such that the supporting member 203 is selectively tiltable relative to the coupling mechanism 204. By non-limiting example, in implementations a plurality of couplers 218 couple (or assist in coupling) the cross member 202 to the coupling mechanism 204. In implementations the couplers 218 may comprise, by non-limiting example, socket head cap screws. By way of non-limiting example, in implementations the couplers 218 may be loosened to allow the supporting member 203 to freely tilt relative to the coupling mechanism 204 and, when a desired tilt is achieved, the couplers 218 may be tightened to secure the supporting member 203 at the desired tilt. Naturally, the couplers 218 may be loosened later to again change and/or adjust the tilt. In this way, the tilt of the supporting member 203 relative to the coupling mechanism 204 may be repeatedly changed as desired.

Figure 14:
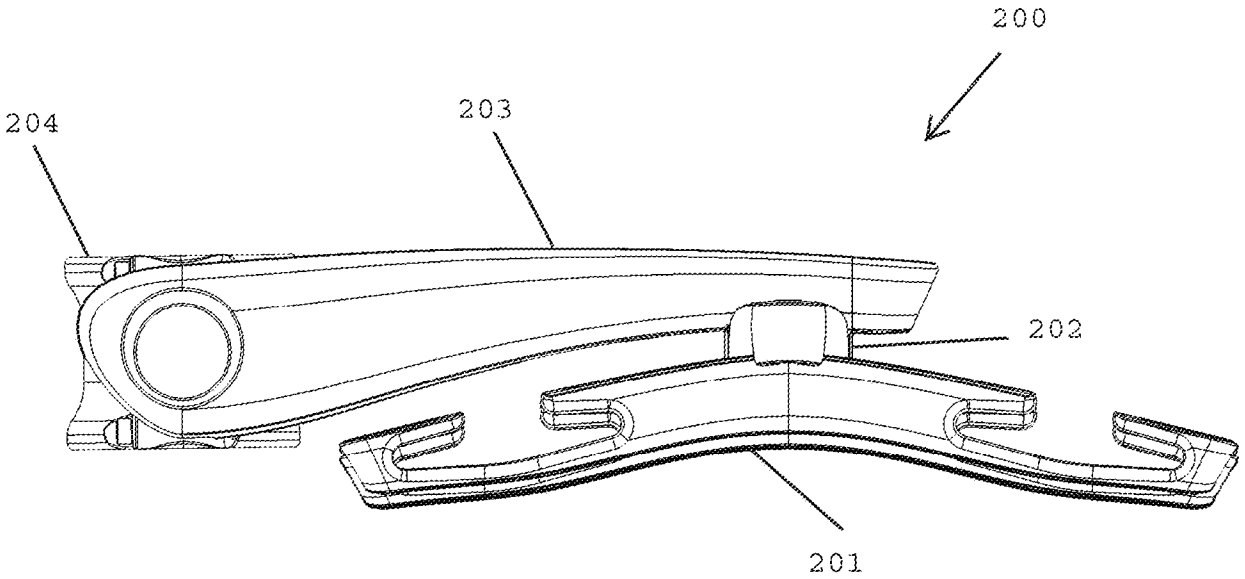
FIG. 14 is a right side view of the rack of FIG. 7.
Figure 15:
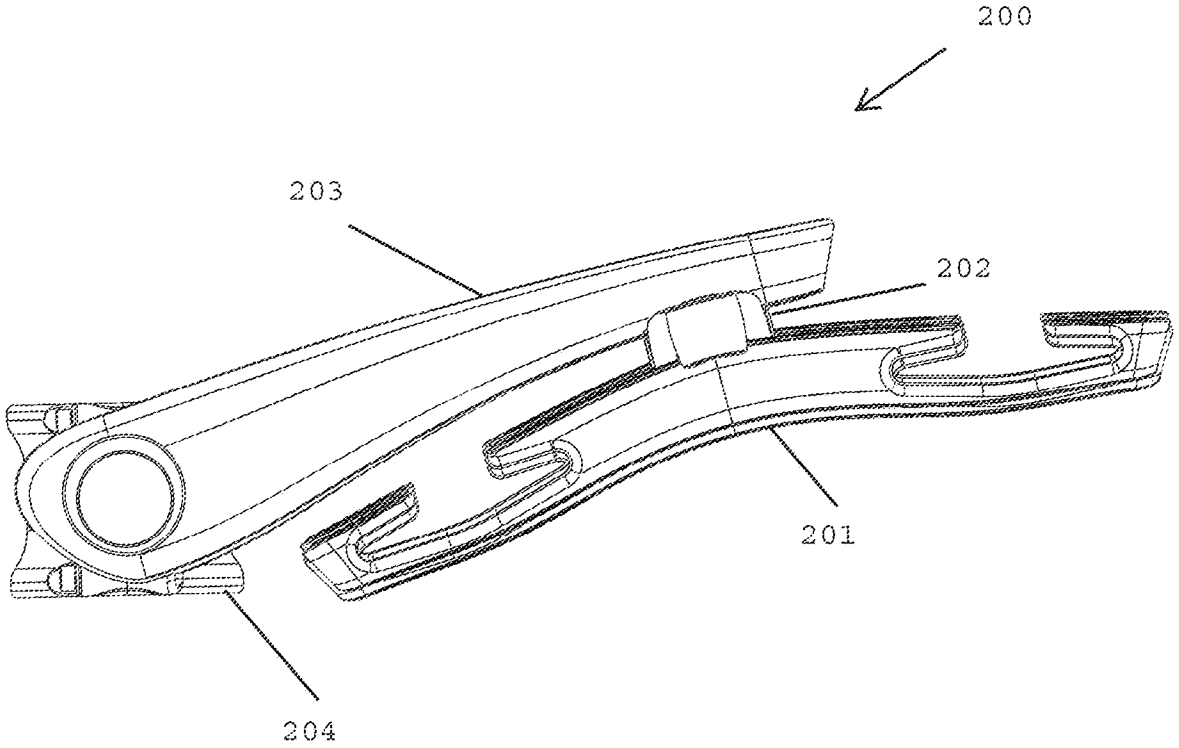
FIG. 15 is the rack of FIG. 14 with the supporting member tilted upwards.
Figure 16:
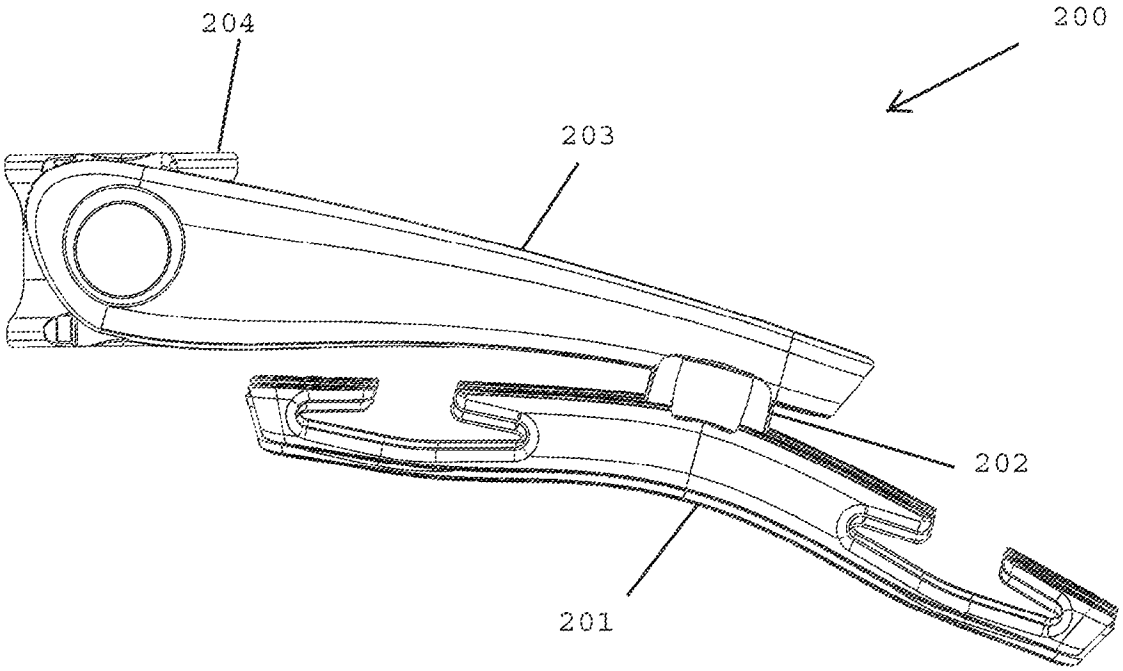
FIG. 16 is the rack of FIG. 14 with the supporting member tilted downwards.

By way of non-limiting example, in FIG. 14 the supporting member 203 is fixed in a relatively horizontal position relative to the coupling mechanism 204, while in FIG. 15 the supporting member 203 is fixed in an upwards-tilted position relative to the coupling mechanism 204, and in FIG. 16 the supporting member 203 is fixed in a downwards-tilted position relative to the coupling mechanism 204. The ability of the supporting member 203 to tilt relative to the coupling mechanism 204 can allow a user to ensure that the supporting member 203 and/or the hangers 201 are generally in a level position relative to a deck 220 of the boat 140 regardless of any tilt or angle of the bar 222 of the tower 130 to which the coupling mechanism 204 is coupled.

In implementations the couplers 218 may not actually couple (or assist in coupling) the supporting member 203 to the coupling mechanism 204 but may only serve to selectively fix the supporting member 203 at a desired tilt relative to the coupling mechanism 204—with some other element(s) or mechanism(s) utilized to actually couple the supporting member 203 to the coupling mechanism 204.

Each hanger 201 has a plurality of slot openings 206, i.e., a first slot opening 206*a* and a second slot opening 206*b*. Each slot opening 206 is defined by one or more inward projecting arms 209*a-b*. The slot opening 206 has a lateral dimension 207*a* and the slot 208 has a lateral dimension 208*a* larger than the lateral dimension 207*a*.

A method of using a rack 200 may include, by way of non-limiting example, one or more or all of the following, in any order, repeated any number of times: coupling the rack 200 to a boat 140; coupling the coupling mechanism 204 to a boat 140; coupling the coupling mechanism 204 to a tower 130 of a boat 140; coupling a supporting member 203 to the coupling mechanism 204; loosening couplers 218 coupling the supporting member 203 to the coupling mechanism 204 to allow the supporting member 203 to freely tilt relative to the coupling mechanism 204; tilting the supporting member 203 relative to the coupling mechanism 204; tightening the couplers 218 to secure the supporting member 203 at a desired tilt relative to the coupling mechanism 204; coupling a cross member 202 to the supporting member 203; coupling one or more hangers 201 to the cross member 202; loosening a coupler 214 to allow the cross member 202 to freely rotate relative to the supporting member 203 on an axis that is substantially collinear with a longest length of the supporting member 203; tightening a coupler 214 to fix the cross member 202 at a desired rotation relative to the supporting member 203; placing one or more life jackets 120 or other items on one or more hangers 201; removing one or more life jackets 120 or other items from the one or more hangers 201; decoupling one or more or all hangers 201 from the cross member 202; decoupling the cross member 202 from the supporting member 203; decoupling the supporting member 203 from the coupling mechanism 204; decoupling the coupling mechanism 204 from a tower 130 of a boat 140; decoupling the coupling mechanism 204 from a boat 140, and; decoupling the rack 200 from a boat 140.

The racks 200 described herein might easily be modified to accommodate clothing outside of water sports, such as winter apparel. Further, the supporting mechanisms might be modified to include or be made from materials that are better suited for colder weather or other environmental conditions. The rack might also be fastened to other recreational vehicles or structures such as yachts, snowmobiles, ATVs, Cars, Trucks, etc.

In places where the description above refers to particular implementations of drying racks and associated methods and implementing components, sub-components, methods and sub-methods, it should be readily apparent that a number of modifications may be made without departing from the spirit thereof and that these implementations, implementing components, sub-components, methods and sub-methods may be applied to other drying racks and associated methods.

What is claimed is:

1. A drying rack, comprising:

a coupling mechanism configured to couple to a boat using a cylindrical cavity;

a supporting member pivotably coupled to the coupling mechanism; and at least one hanger coupled to the supporting member, the at least one hanger configured to hang a wet material to dry;

wherein the supporting member pivots, relative to the coupling mechanism, to a plurality of positions, in a plane parallel with an axis of the cylindrical cavity, at least one of the plurality of positions of the supporting member allowing an overall longest length of the at least one hanger to be positioned substantially parallel to a deck of the boat;

wherein the at least one hanger comprises two slots, each slot at least partially defined by two inward projecting arms.

2. The device of claim 1, wherein the at least one hanger is configured to hang the wet material in a configuration such that the wet material will not drip onto the deck, and wherein the axis of the cylindrical cavity is fully comprised in the plane in which the supporting member pivots.

3. The device of claim 1, wherein the supporting member is configured to allow the overall longest length of the at least one hanger to pivot counter-clockwise from a parallel position relative to the deck and clockwise from the parallel position relative to the deck, and wherein the at least one hanger does not comprise a cylindrical rod.

4. The device of claim 3, wherein the supporting member is configured to allow the overall longest length of the at least one hanger to pivot at least 30 degrees counter-clockwise from the parallel position relative to the deck and at least 30 degrees clockwise from the parallel position relative to the deck, and wherein the overall longest length of the at least one hanger is parallel with an overall longest length of the supporting member in at least one configuration.

5. The device of claim 1, wherein each inward projecting arm is comprised of a rigid, non-bendable material and at least partially defines a slot opening of one of the slots, each slot opening having a lateral dimension that is smaller than a lateral dimension of the slot to which the slot opening provides access.

6. The device of claim 1, wherein the at least one hanger is coupled to the supporting member using a cross member, an overall longest length of the cross member being substantially perpendicular to the overall longest length of the at least one hanger, and wherein the at least one hanger comprises at least three parallel hangers.

7. The device of claim 1, wherein the coupling mechanism is configured to fully circumscribe a bar of a boat tower of the boat in a tight configuration, wherein a cross member is coupled to the supporting member such that an overall longest length of the cross member is substantially perpendicular to an overall longest length of the supporting member; and wherein the cross member is configured to pivot, relative to the supporting member, in a plane parallel with the axis of the cylindrical cavity, to a plurality of positions, at least one of the plurality of positions of the cross member allowing the overall longest length of the cross member to be positioned substantially parallel to the deck of the boat.

8. The device of claim 1, wherein the drying rack further comprises a bar of a boat tower, and wherein the coupling mechanism is attached to the bar through a size adjuster.

9. The device of claim 1, wherein a cross member is coupled to the supporting member such that an overall longest length of the cross member is substantially perpendicular to an overall longest length of the supporting member; and wherein the cross member pivots, relative to the supporting member, in a plane perpendicular with the plane in which the supporting member pivots, to a plurality of positions, at least one of the plurality of positions of the cross member allowing the overall longest length of the cross member to be positioned substantially parallel to the deck of the boat.

10. A drying rack, comprising:

a coupling mechanism configured to couple to a boat using a hollow cylinder having a cylindrical cavity;

a supporting member coupled to the coupling mechanism at two locations on a side of the hollow cylinder;

a cross member coupled to the supporting member such that an overall longest length of the cross member is substantially perpendicular to an overall longest length of the supporting member; and at least one hanger coupled to the cross member, the at least one hanger configured to hang a wet material to dry;

wherein the cross member is configured to pivot, relative to the supporting member, in a plane parallel with an axis of the cylindrical cavity, to a plurality of positions, at least one of the plurality of positions of the cross member allowing the overall longest length of the cross member to be positioned substantially parallel to a deck of the boat.

11. The device of claim 10, wherein the at least one hanger is configured to hang the wet material in a configuration such that the wet material will not drip onto the deck, and wherein the supporting member is coupled to the coupling mechanism at two opposing locations on the side of the hollow cylinder.

12. The device of claim 10 wherein the supporting member is configured to allow an overall longest length of the at least one hanger to pivot counter-clockwise from a parallel position relative to the deck and clockwise from the parallel position relative to the deck, and wherein the cross member does not comprise a cylindrical rod.

13. The device of claim 12, wherein the supporting member is configured to allow the overall longest length of the at least one hanger to pivot at least 30 degrees counter-clockwise from the parallel position relative to the deck and at least 30 degrees clockwise from the parallel position relative to the deck, and wherein the supporting member does not comprise a cylindrical rod.

14. The device of claim 10, wherein each hanger comprises two slots and each slot is at least partially defined by at least one inward projecting arm, wherein each inward projecting arm extends towards another inward projecting arm and at least partially defines a slot opening of one of the slots, each slot opening having a lateral dimension that is smaller than a lateral dimension of the slot to which the slot opening provides access.

15. The device of claim 14, wherein each slot is at least partially defined by two non-bendable, rigid inward projecting arms.

16. The device of claim 10, wherein the coupling mechanism is configured to fully circumscribe a bar of a boat tower in a tight configuration, and wherein the supporting member pivots about an axis comprising the two locations on the side of the hollow cylinder.

17. The device of claim 10, wherein the drying rack further includes a bar of a boat tower, and wherein the coupling mechanism is attached to the bar, and wherein the supporting member pivots in a plane parallel with and comprising the axis of the cylindrical cavity.

18. A drying rack, comprising:

a coupling mechanism configured to attach to a boat tower of a boat by fully circumscribing a bar of the boat tower in a tight configuration; and four parallel hangers coupled to the coupling mechanism, each of the four parallel hangers configured to hang a wet material to dry such that the wet material will not drip onto a deck of the boat;

wherein each of the four parallel hangers comprises two slots and each slot is defined by two rigid, non-bendable inward projecting arms extending towards one another, the two slots of each of the four parallel hangers configured to together receive a life jacket by each slot receiving a shoulder portion of the life jacket;

wherein each inward projecting arm at least partially defines a slot opening of one of the slots, each slot opening having a lateral dimension that is smaller than a lateral dimension of the slot to which the slot opening provides access, and;

wherein each slot is aligned with at least three other slots along a direction perpendicular with an overall longest length of each of the four parallel hangers.

19. The device of claim 18, wherein the drying rack further comprises the bar of the boat tower, and wherein the coupling mechanism is attached to the bar through two sections of a compressible material shaped to mate with one another, and wherein the lateral dimension of the slot opening is comprised in a different plane than the lateral dimension of the slot.

* * * * *